US006158194A

United States Patent [19]

Horn et al.

[11] Patent Number: 6,158,194

[45] Date of Patent: Dec. 12, 2000

[54] APPARATUS FOR TRANSPORTING ROD-SHAPED ARTICLES OF THE TOBACCO PROCESSING INDUSTRY

[75] Inventors: Matthias Horn, Ahrensburg; Carsten Becker, Hamburg, both of Germany

[73] Assignee: Hauni Maschinenbau AG, Hamburg, Germany

[21] Appl. No.: 09/213,266

[22] Filed: Dec. 17, 1998

[30] Foreign Application Priority Data

Dec. 17, 1997 [DE] Germany ..... 197 56 138

[51] Int. Cl.[7] ..... B65B 35/30

[52] U.S. Cl. ..... 53/148; 53/236; 414/403

[58] Field of Search ..... 53/148, 151; 414/403, 414/282

[56] References Cited

U.S. PATENT DOCUMENTS

| | | | |
|---|---|---|---|
| 3,610,448 | 10/1971 | Bornfleth . | |
| 3,735,767 | 5/1973 | Kruse et al. . | |
| 3,741,846 | 6/1973 | Greve . | |
| 4,085,759 | 4/1978 | Seragnole | 131/25 |
| 4,092,816 | 6/1978 | Seragnoli | 53/234 |
| 4,202,151 | 5/1980 | Focke et al. | 53/378 |
| 4,278,385 | 7/1981 | Bardenhagen et al. . | |
| 4,489,534 | 12/1984 | Gömann et al. . | |
| 4,509,310 | 4/1985 | Focke et al. | 53/170 |
| 4,710,066 | 12/1987 | Kägeler et al. . | |
| 4,721,119 | 1/1988 | Ludszeweit . | |
| 4,892,453 | 1/1990 | Bantien et al. | 414/403 |
| 5,072,742 | 12/1991 | Heitmann . | |
| 5,123,798 | 6/1992 | Glosmann et al. | 414/403 |
| 5,460,590 | 10/1995 | Greiner et al. | 493/4 |
| 5,553,988 | 9/1996 | Horn et al. . | |
| 5,590,449 | 1/1997 | Chehab et al. . | |
| 5,597,219 | 1/1997 | Horn et al. . | |
| 5,629,162 | 5/1997 | Kreusch et al. . | |
| 5,701,718 | 12/1997 | Spada | 53/201 |
| 5,718,103 | 2/1998 | Spada | 53/466 |
| 5,725,467 | 3/1998 | Chehab et al. | 493/42 |

FOREIGN PATENT DOCUMENTS

| | | |
|---|---|---|
| 0643002B1 | 10/1997 | European Pat. Off. . |
| 2018442 | 10/1971 | Germany . |
| 2552671 | 6/1976 | Germany . |
| 4404902A1 | 8/1995 | Germany . |
| 3706114A1 | 8/1997 | Germany . |
| 196 22 995A1 | 12/1997 | Germany . |
| 608449 | 1/1979 | Switzerland . |

*Primary Examiner*—Stephen F. Gerrity
*Assistant Examiner*—Sam Tawfik
*Attorney, Agent, or Firm*—Venable; George H. Spencer; Robert Kinberg

[57] ABSTRACT

A battery of rod making machines of the tobacco processing industry (such as plain or filter cigarette makers or filter rod makers) is separated from a battery of processing machines (such as cigarette packing or filter tipping machines) by a magazine which is provided with compartments for discrete containers. Articles which are turned out by the making machines are introduced into so-called trays, and groups of filled trays are introduced into containers which are delivered into the compartments of the magazine for temporary storage, or directly to the processing machines, A container which is to furnish articles to a processing machine is relieved of filled trays, and the contents of the filled trays are conveyed to one or more selected processing machines. The thus emptied trays are returned into containers, and such containers are thereupon delivered into the magazine or directly to one or more selected rod making machines.

20 Claims, 2 Drawing Sheets

APPARATUS FOR TRANSPORTING ROD-SHAPED ARTICLES OF THE TOBACCO PROCESSING INDUSTRY

CROSS-REFERENCE TO RELATED APPLICATIONS

This application claims the priority of German patent application Serial No. 197 56 138.1 filed Dec. 17, 1997. The disclosure of the German Patent application, as well as that of each U.S. and foreign patent and patent application mentioned in the specification of the present applications is incorporated herein by reference.

BACKGROUND OF THE INVENTION

The invention relates to improvements in apparatus for transporting rod-shaped articles, and more particularly to improvements in apparatus for transporting rod-shaped articles (such as plain and/or filter cigarettes and/or filter rod sections) of the tobacco processing industry. Still more particularly, the invention relates to improvements in apparatus and groups of apparatus which are designed to confine rod-shaped articles in so-called trays which, in turn, are configurated and dimensioned to be confined in so-called containers serving to transport filled trays to processing (such as cigarette packing or filter tipping) machines and to transport empty trays back to the rod making machine or machines, such as filter rod making or cigarette rod making machines.

Apparatus of the above outlined character are often equipped with storage facilities for filled and empty containers. Reference may be had, for example, to U.S. Pat. No. 5,628,162 granted May 13, 1997 to Christian Kreusch et al. for "PLANT FOR MAKING AND PACKAGING CIGARETTES" which discloses various connections between groups of cigarette making and cigarette packaging machines. The connections are established by remote control-operated vehicles (called floor conveyors) which transport filled containers from the making machines to storage and (when necessary) from storage to processing machines. The floor conveyors also serve to transport containers with empty trays from storage back to the making machines.

SUMMARY OF THE INVENTION

An object of the invention is to provide a novel and improved apparatus which constitutes an improvement over and a further development of apparatus disclosed in U.S. Pat. No. 5,628,162 to Kreusch et al.

Another object of the invention is to provide an apparatus which can operate, highly satisfactorily, without floor conveyors.

A further object of the invention is to provide the above outlined apparatus with novel and improved means for delivering containers with filled or empty trays to the machines or groups of machines which are designed to fill empty trays with freshly manufactured rod-shaped articles of the tobacco processing industry, or to remove the contents of filled trays for introduction into one or more processing machines.

An additional object of the invention is to provide a novel and improved automated connection between groups of rod making and consuming or processing machines in a cigarette producing plant.

Still another object of the invention is to provide a space-saving array of cigarette making and processing (such as packing) machines which are coupled to a common storage system.

Another object of the invention is to provide a novel and improved combination or connection between filter rod making and filter tipping machines.

An additional object of the invention is to provide a novel and improved method of furnishing to making and processing machines of the tobacco processing industry supplies of empty and filled trays for arrays of rod-shaped articles.

SUMMARY OF THE INVENTION

The invention pertains to an apparatus for manipulating rod-shaped articles of the tobacco processing industry which are turned out by producing machines and are temporarily stored in trays which, in turn, can be stored in containers of the type arranged to confine a plurality of trays preparatory to delivery of articles to processing machines. The improved apparatus comprises at least one magazine having facilities for temporary storage of first containers which confine trays at least partially filled with articles turned out by the processing machines and of second containers accommodating trays which are empty as a result of delivery of articles to the processing machines, and transfer means for delivering containers between the producing and processing machines along a route which bypasses the at least one magazine.

The transfer means can comprise at least one elevator having means for transporting containers between a plurality of levels, and/or means for transporting containers along at least one at least substantially horizontal path.

The magazine can comprise at least one at least substantially straight set of facilities for temporary storage of containers, and such facilities can include discrete compartments for containers. For example, the magazine can comprise a plurality of sections each having facilities for temporary storage of containers. Such sections can include a first section with facilities for temporary storage of first containers, and a second section with facilities for temporary storage of second containers. Alternatively, at least one section can be provided with facilities for temporary storage of first and second containers.

The magazine can be constructed and installed in such a way that it is flanked by the producing and processing machines. Thus, a battery of producing machines can be installed at one side and a battery of processing machines can be installed at the other (opposite) side of the magazine.

The transfer means can further comprise means for conveying first containers between the producing machines and the facilities of the magazine, and means for conveying second containers between the facilities of the magazine and the processing machines.

The producing machines can comprise makers of filter rod sections, means for filling empty trays with filter rod sections, and means for delivering filled trays into containers. The processing machines of such apparatus can comprise fluid-operated (such as pneumatic) conveyors, and the transfer means of such apparatus can further comprise means for evacuating filled trays from second containers and means for thereafter delivering filter rod sections from filled trays to the fluid-operated conveyors.

The producing machines can comprise cigarette makers, means for filling trays with cigarettes, and means for delivering filled trays into containers. The processing machines of such apparatus can comprise cigarette packing machines, and the transfer means of such apparatus can further comprise means for evacuating filled trays from second containers and means for thereafter delivering cigarettes from filled trays to the packing machines. The packing machines can comprise means for confining arrays of cigarettes in so-called hard packs, and such packing machines can further comprise means for wrapping hard packs into envelopes, e.g., into light-transmitting envelopes of cellophane or the like.

Each producing machine which turns out cigarettes or analogous tobacco-containing rod-shaped articles can comprise a cigarette maker and a filter tipping machine which receives cigarettes from the maker and filter rod sections from a filter rod making machine. If the articles are filter rod sections, each producing machine can comprise a filter tow processing machine and a filter rod making machine which receives processed filter tow from the respective filter tow processing machine.

The magazine can comprise a plurality of storeys or levels and facilities (such as discrete compartments) at least at one of the storeys.

The novel features which are considered as characteristic of the invention are set forth in particular in the appended claims. The improved apparatus itself, however, both as to its construction and the modes of assembling and operating he same, together with numerous important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
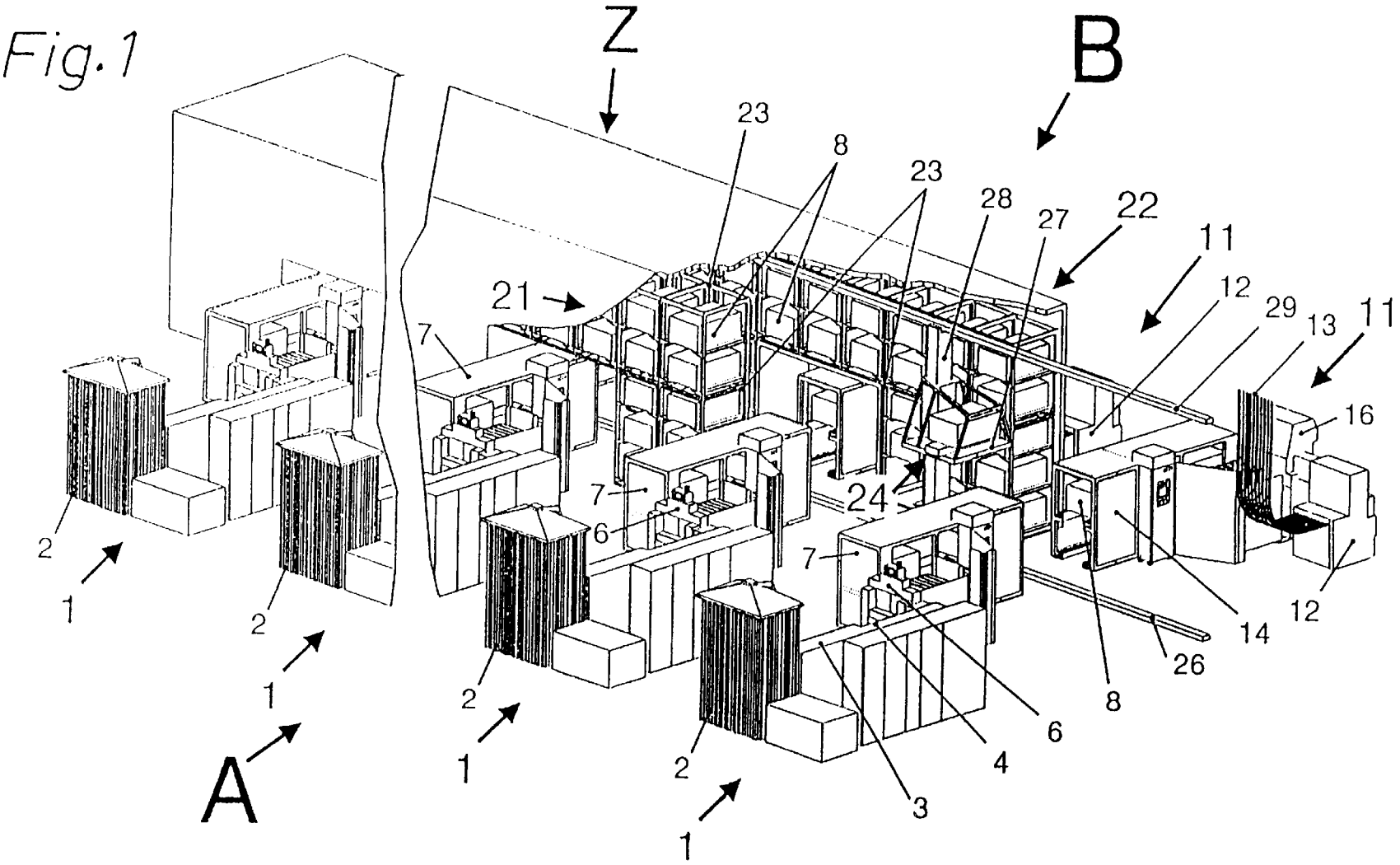
FIG. 1 is a somewhat schematic perspective view of an apparatus which is designed for the transport of rod-shaped articles of the tobacco processing Industry, namely filter rod sections, in accordance with one presently preferred embodiment of the invention.

The apparatus or assembly of FIG. 1 is a set of production lines and includes a battery or group of four filter rod making and subdividing machines 1 (hereinafter called makers for short). The number of makers in a cigarette producing plant can greatly exceed the number which is shown in FIG. 1. Each maker 1 comprises a combination of a filter tow processing machine 3 (e.g., of the type known as AF and distributed by the assignee of the present application) and a filter rod making machine 4, e.g., a machine known as KDF and also distributed by the assignee of the present application. Unless otherwise stated, all machines which are referred to by trademarks, trade names and/or other designations utilized in and known to those familiar with the field of tobacco processing are produced and distributed by the assignee of the present application. Machines similar to those shown at 3 and 4 are described and illustrated in commonly owned U.S. Pat. No. 5,590,449 granted Jan. 7, 1997 to Firdausia Chehab et al, for "APPARATUS FOR STRETCHING, PLASTICIZING AND GATHERING A TOW OF FILTER MATERIAL FOR TOBACCO SMOKE" and in U.S. Pat. No. 3,741,846 granted Jun. 26, 1973 to Heinz Greve for "MACHINE FOR THE PRODUCTION OF FILTER ROD SECTIONS OR THE LIKE".

Each machine 4 draws a continuous tow of filter material for tobacco smoke (such as cellulose acetate fibers) from a bale 2. Successive increments of the tow are stretched and converted into portions of a substantially flat layer which is contacted by droplets of a plasticizer (such as triacetin), and the thus processed layer is fed to the respective machine 4 which converts the layer into a rod-like filler ready to be draped into a web of cigarette paper, imitation cork or other suitable wrapping material. The resulting continuous filter rod is subdivided into filter rod sections of unit length or multiple unit length, and such sections are ready to be combined with plain cigarettes (or other rod-shaped tobacco-containing products) in a so-called filter tipping machine to form with the plain cigarettes a series of filter cigarettes of desired length.

The machine 4 of each maker 1 in the group A is followed by a tray filling unit 6 wherein successive empty trays receive arrays of parallel filter rod sections, normally in a so-called quincunx formation. A tray which can be filled in a unit 6 is normally designed in such a way that it is open from above and at its front side but includes two sidewalls, a rear wall and a bottom wall. Certain tray filling units which can be utilized (at 6) in or with the makers 1 of the group A (and enjoy widespread use in the field of filter cigarette making) are known as HCF and are described and illustrated in the assignee's U.S. Pat. No. 4,489,534 granted Dec. 15, 1984 to Rolf Gömann et al. for "APPARATUS FOR FILLING TRAYS WITH CIGARETTES OR THE LIKE". Successive filled trays are delivered to a so-called full-tray accepting station of the unit 6, and this station is associated with a transporting unit 7 which can be used to deliver filled trays into empty containers 8. Transporting units which can be utilized at 7 in each of the makers 1 forming part of the group A shown in FIG. 1 are fully described and illustrated in commonly owned U.S. Pat. No. 5,597,219 (granted Jan. 28, 1997 to Matthias Horn et al. for "MOBILE RECEPTACLES FOR CIGARETTE TRAYS"), in commonly owned U.S. Pat. No. 5,553,988 (granted Sep. 10, 1996 to Matthias Horn et al. for "METHOD OF AND APPARATUS FOR MANIPULATING CONTAINERS FOR CIGARETTE TRAYS"), and in German patent application Serial No. 196 22 995 A 1 (published Dec. 11, 1997, entitled "METHOD OF AND APPARATUS FOR THE MANIPULATION OF CIGARETTE TRAYS" and naming Matthias Horn as the sole inventor). The just enumerated U.S. patents and German patent application further show the details of suitable trays and containers. Transporting units which can be utilized at 7 in the apparatus of FIG. 1 are also known as CHS and are used extensively in cigarette making plants in the United States of America as well as abroad. Containers which confine filled trays are shown at 8 at the discharge ends of the transporting units 7.

The apparatus or assembly which is shown in FIG. 1 further comprises a group or battery B of processing machines and filling arrangements 11. A machine 11 is or can be provided for each maker 1, and each such machine includes or constitutes a pneumatic conveyor 12 for filter rod sections, Each conveyor 12 comprises a set of tubes 13 which guide filter rod sections into filter tipping machines (see the machines 118 in FIG. 2), e.g., machines of the type known as MAX. Conveyors of the type adapted to be utilized (at 12) in the group B of FIG. 1 are known as FILTROMAT and are described and shown in commonly owned U.S. Pat. No. 4,710,066 granted Dec. 1, 1987 to Peter Kägeler et al. for "METHOD AND APPARATUS FOR PNEUMATICALLY TRANSPORTING FILTER ROD SECTIONS AND THE LIKE".

Each conveyor 12 is Preceded by a tray evacuating unit 14 which is designed to remove filled trays from their containers 8 and which can be of the type known as CHS. Reference may be had, for example, to the aforementioned U.S. Pat. No. 5,597,219 to Horn et al., to the aforementioned U.S. Pat. No. 5,553,988 to Horn et al., and/or to the aforementioned published German patent application Serial No. 196 22 995 A 1 of Horn.

The filled trays which are removed from their containers 8 by the respective evacuating units 14 are delivered to discrete article removing or evacuating units 16, e.g., of the type known as MAGOMAT and described and shown in U.S. Pat. No. 4,278,385 granted Jul. 14, 1981 to Dietrich Bardenhagen et al. for "APPARATUS FOR TRANSFERRING CIGARETTES OR THE LIKE FROM TRAYS INTO MAGAZINES OF PACKING MACHINES OR THE LIKE". When necessary, filter rod sections which are removed from trays by a removing unit 16 are delivered into a magazine of the corresponding conveyor 12. Such magazine supplies filter rod sections to the respective set of tubes 13 which, in turns deliver filter rod sections to the consuming machines (e.g., of the type known as MAX).

Empty trays are delivered to the empty tray evacuating unit 16 (such as the aforementioned MAGOMAT) and thence back to the evacuating unit (CHS) 14. The unit 14 includes means for introducing empty trays into empty containers 8, and the thus filled or refilled containers are temporarily stored in a magazine Z or are returned directly to the respective maker 1. A container 8 which confines an array of empty trays is relieved of such trays by the respective transporting unit (CHS) 7, and each unit 7 delivers empty trays to the respective tray filling unit (HCF) 6. Such trays are refilled with arrays of parallel filter rod sections by the corresponding filter tow processing machine (AF) 3 and the associated filter rod making machine (KDF) 4.

The aforementioned magazine Z is installed between (i.e., it is flanked by) the batteries or groups A, B and comprises two sections 21, 22 each of which can comprise a set of shelves (at different levels) with facilities or compartments 23 for temporary confinement of containers 8 which store filled or empty trays. A transfer device 24 which delivers containers 8 to and/or withdraws such contaners from the facilities or compartments 23 can be said to constitute a carriage in that it is movable along an elongated horizontal rail 26. An elevator platform 27 which is adjacent an upright guide column 28 is movable up and down along or adjacent the column 28 and, when raised, along a second elongated horizontal rail 29 at a level above and parallel to the lower rail 26.

A telescopically extendable or shortenable arm is employed to transfer filled containers 8 from the makers 1 into the compartments 23 of the magazine section 21 or 22. The arm and the platform 27 of the transfer device 24 can further serve to deliver filled containers 8 from one of the makers 1 directly to the group B, e.g., directly to an evacuating unit (CHS) 14, when the device 24 receives an appropriate signal from the controls of the improved apparatus. In other words, temporary storage of containers 8 in the magazine Z is optional.

The sections 21, 22 of the magazine Z are provided with openings or windows for containers 8; the windows are located in the paths of advancement of containers between a maker 1 and the corresponding (aligned) processing machine 11, i.e., from a maker 1 to the aligned processing machine 11 or in the opposite direction.

The arrangement can be such that the section 21 or 22 can receive and temporarily store only filled (first) containers whereas the section 22 or 21 receives and temporarily stores only empty (second) containers 8. However, it is presently preferred to resort to a so-called chaotic storage which involves storage of empty and filled containers 8 in at least one or in each of the sections 21, 22. Identification of the locations of empty and filled containers 8 in the section 21 and/or 22 can be effected electronically.

The transfer device 24 can be of any known design, For example, one can employ an automatically controllable transfer device known as DESTAMAT II which is distributed by the Firm Mannesmann Demag Fördertechnik AG having a place of business at D-58286 Wetter, Federal Republic Germany.

The mode of operation of the apparatus of FIG. 1 is as follows:

A filter tow processing machine 3 cooperates with the filter rod making machine 4 of the respective maker 1 to furnish filter rod sections which are confined in trays by the associated tray filling unit 6, and the latter delivers freshly filled trays to the transporting unit 7 which introduces, at proper times, filled trays into empty containers 8. The column 28 of the device 24 is advanced to those machines 3, 4 which are ready to deliver a container 8 confining a supply of filled trays. The aforementioned telescoped arm of the device 24 engages the filled container 8 and delivers it to the platform 27. In the next step, the column 28 is advanced to an unoccupied compartment 23 which receives the filled container for temporary storage in the section 21 or 22 of the magazine Z; such introduction can involve a lifting or a lowering of the platform 27 to the level of the selected empty compartment 23. The actual delivery of a filled container 8 from the platform 27 into the selected empty compartment 23 is effected by the aforementioned telescoped arm of the transfer device 24.

The minimum duration of storage of a container 8 in the selected compartment 23 is normally and preferably selected in such a way that the plasticizer and/or the adhesive of each filter rod section in a filled tray is allowed to set.

If a processing machine 11 (or its pneumatic conveyor 12) transmits a signal denoting that such machine requires a fresh supply of filter rod sections, the column 28 and the platform 27 are advanced along one of the guide rails 26, 29 and on to the chosen compartment 23 confining a filled container 8 (namely, to any one of the compartments 23 which contain filled containers 8), the aforementioned telescoped arm withdraws the filled container 8 from the selected compartment 23 and deposits the withdrawn container on the platform 27 for delivery to the evacuating unit (CHS) 14 of the processing machine 11 which has reported the need for filter rod sections.

Filter rod sections are removed from the filled trays of the container 8 on the platform 27 at the selected processing machine 11, and the container 8 with empty trays is delivered by the transfer device 24 to a selected empty compartment 23 of the magazine Z. Such container 8, with an array of empty trays therein, remains in the corresponding compartment 23 until the transfer device 24 receives a signal denoting that one of the combinations of machines 3, 4 is in need of empty trays. The container 8 with empty trays is delivered to the transporting unit 7 of such combination of machines 3 and 4.

The delivery of containers 8 by means of the transfer device 24 amounts to a direct coupling between the groups or batteries A, B and renders it possible to eliminate the need for the conventional floor-mounted conveyors.

If the nature of the filter rod sections which are turned out by the combinations of machines 3, 4 is such that there is no need for a setting time or that the required setting times are short (or very short), the container transfer device 24 can be used to bypass the magazine Z, i.e., to deliver containers 8 with filled trays directly from the machines 3, 4 of the group A to the selected processing machine 11 of the group B.

Figure 2:
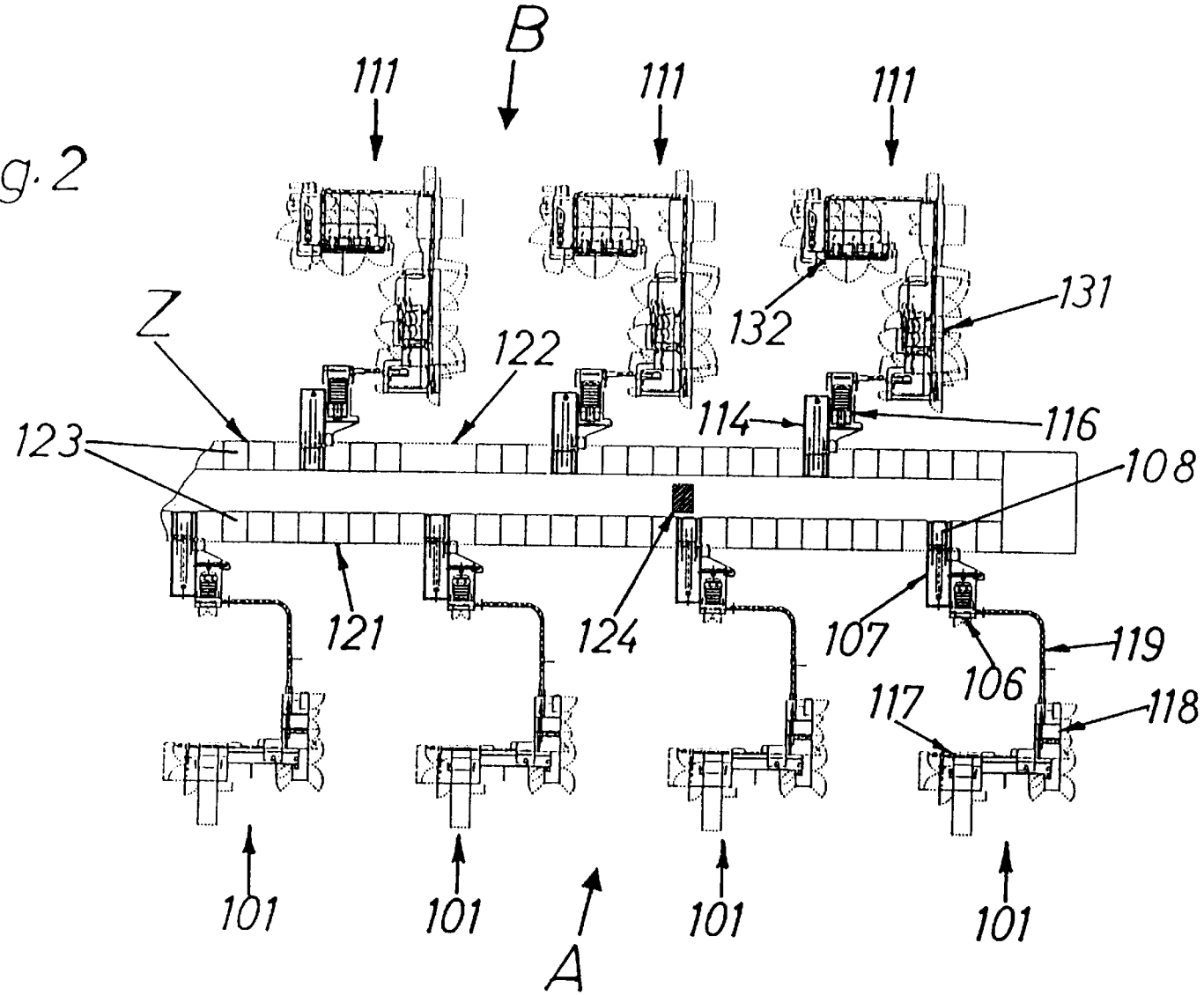
FIG. 2 is a somewhat schematic plan view of an apparatus which is designed for the making, transport and temporary storage of plain and filter cigarettes.

FIG. 2 illustrates certain details of an apparatus which can be utilized to transport containers 108 for filled or empty trays from the group or battery A of cigarette makers 101 to the group or battery B of cigarette processing machines 111, either directly or by way of a magazine Z. The parts shown in FIG. 2 and corresponding to the parts in the apparatus of FIG. 1 are denoted by similar reference characters plus 100. For example, the magazine Z of FIG. 2 has two sections 121, 122 provided with facilities or compartments 123 for containers 108 which confine arrays of filled or empty trays for plain cigarettes or filter cigarettes.

The group A of the apparatus which is shown in FIG. 2 comprises a plurality of producing machines or makers 101 each of which can constitute or comprise a cigarette rod making machine 117 of the type known as PROTOS and fully described and shown in commonly owned U.S. Pat. Nos. 4,721,119 (granted Jan. 26, 1988 to Dieter Ludszeweit et al. for "ROD MAKING MACHINE WITH MEANS FOR ADJUSTING THE POSITION OF WRAPPING MATERIAL") and 5,072,742 (granted Dec. 17, 1991 to Uwe Heitmann for "METHOD OF AND APPARATUS FOR MAKING A FILLER OF SMOKABLE MATERIAL").

Cigarettes which are produced in the makers 101 (or filter cigarettes of e.g., unit length) are stored in suitable trays in a tray filling unit (HCF) 106, and a transporting unit (CHS) 107 is employed to deliver filled trays into successive containers 108. A transfer device 124 is provided to transport filled containers 108 into empty compartments 123 of the section 121 or 122 of the magazine Z; alternatively, and when the need arises, the platform of the transfer device 124 can deliver filled containers 108 from a transporting unit 107 directly to one of the series of processing machines 111 of the group B. For example, each processing machine 111 can include or constitute or form part of a cigarette packing machine. Packing machines (known as COMPAS) which can be utilized at 111 in the group B shown in FIG. 2 are disclosed, for example, in U.S. Pat. No. 3,735,767 granted May 29, 1973 to Friedel Kruse et al. for "METHOD AND MACHINE FOR THE MAKING OF CIGARETTE PACKS OR THE LIKE".

The manner in which containers 108 (confining arrays of empty or filled trays for the storage of cigarettes) can be introduced into or withdrawn from the compartments 123 of the sections 121 and/or 122 is the same as or clearly analogous to that already described with reference to the magazine Z in the apparatus of FIG. 1.

Containers 108 which are withdrawn from the compartments 123 of the sections 121 or 122 (or which are transported directly to the selected processing machines 111) are delivered to the selected tray evacuating units (CHS) 114 which, in turn, deliver filled trays to the associated cigarette removing or evacuating units (MAGOMATS) 116. The selected unit 116 delivers plain or filter cigarettes to the magazine of the respective packing machine (COMPAS) 111. Empty trays are returned to the respective transporting units (CHS) 107 which, in turn, transport such trays to the respective filling units (HCF) 106 which introduce the trays into empty containers 108. The thus filled containers 108 (which contain empty trays) are delivered into empty compartments 123 of the section 121 or 122 in the magazine Z, or directly to the selected transporting units (CHS) 107 for delivery to the respective filling units (HCF) 106. The units 106 retain empty trays until such trays are again filled by the respective makers 101.

FIG. 2 shows that each maker 101 can comprise a machine 117 for the making of plain cigarettes and a tipping machine 118 which is designed to receive plain cigarettes from the machine 117 and filter rod sections (e,g., from a set of tubes 13) to form filter cigarettes. A conveyor system 119 serves to deliver filter cigarettes from the tipping machine 118 to the corresponding filling unit (CHS) 106.

The processing machines 111 in the group B of the apparatus shown in FIG. 2 can comprise well known packing machines 131 which are designed to confine arrays of say twenty filter cigarettes in so-called hard packs, and wrapping machines 132 which are set up to confine the hard packs in transparent or translucent wrappers or the like.

An important advantage of the improved apparatus is its simplicity. Thus, the aforementioned floor conveyors are no longer necessary, containers 8 or 108 with filled trays can be delivered into the magazine Z or directly to a particular processing machine, and containers with empty trays can be delivered to the magazine or directly to selected producing machines.

Another advantage of the improved apparatus is that the operation of its mobile parts (such as those shown in FIG. 1 at 6, 7, 24, 14 and 16) can be automated in a simple and efficient manner.

Furthermore, the improved apparatus and its magazine are relatively simple, compact and inexpensive, and the transfer of rod-shaped articles from the makers into trays, of filled trays into containers, of filled containers into storage or to the processing machines, as well as of empty trays into empty containers and of containers (confining empty trays) in the opposite direction can be completed within surprisingly short intervals of time.

It is clear that the improved apparatus is susceptible of numerous additional modifications without departing from the spirit of the present invention. For example, the construction of the transfer device 24 or 124 can be greatly simplified if the magazine Z contains a single section (such as 21, 22, 121 or 122) and has a single storey, i.e., a single layer of compartments 23 or 123 all of which are located at the same level. It will be seen that each of the two sections 21, 22 of the magazine Z which is shown in FIG. 1 contains several storeys of compartments 23.

The elevator including the platform 27 of the transfer device 24 shown in FIG. 1 (and the corresponding elevator of the transfer device 124) can be designed to move containers 8 between two or more levels or stories along a vertical path or along a path merely having a vertical component.

An important advantage of the magazine Z is that it can temporarily confine smaller or larger numbers of containers 8 or 108 with empty or filled trays when the rate of processing rod shaped articles by the machines 11 or 111 exceeds the rate at which the articles are turned out by the producing machines 1 or 101, or vice versa. Moreover, and as already mentioned above, certain types of filter rod sections must be stored for predetermined periods of time to ensure adequate setting of plasticizer and/or adhesive before the filter rod sections are ready to be assembled with plain cigarettes, cigars, cigarillos or the like in a filter tipping machine.

The aforementioned telescoped arm of the transfer device 24, 124 can be of any known design. For example, one can employ a retractable and extendable, pressure-medium-actuated telescopic member illustrated in EP-patent 0 643 002.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of apparatus for transporting rod-shaped articles of the tobacco processing industry and, therefore, such adaptations should and are intended to be comprehended within the meaning and range of equivalence of the appended claims.

What is claimed is:

1. An apparatus for manipulating rod-shaped articles for tobacco processing produced by producing machines, utilizing trays for temporarily storing the articles and containers for holding a plurality of the trays, to deliver the articles to processing machines, comprising:

means for delivering at least partially filled trays from the producing machines into containers, thereby making containers of at least partially filled trays;

means for evacuating the at least partially filled trays from the containers of at least partially filled trays, for delivery of the items to the processing machines, whereby the trays are emptied and for returning empty trays to the containers;

at least one magazine having means for temporarily storing (a) containers of at least partially filled trays and (b) containers of empty trays; and transfer means for delivering, along a route which bypasses said at least one magazine, at least one of (a) containers of at least partially filled trays from the producing machines to the processing machines and (b) containers of empty trays from the processing machines to the producing machines.

2. The apparatus of claim 1, wherein said transfer means comprises at least one elevator having means for transporting containers between a plurality of different levels.

3. The apparatus of claim 2, wherein said transfer means further comprises means for transporting containers along a path having at least one substantially horizontal path portion.

4. The apparatus of claim 1, wherein said transfer means comprises means for transporting containers along a path having at least one substantially horizontal path portion.

5. The apparatus of claim 1, wherein said magazine comprises at least one at least substantially straight set of facilities for temporary storage of containers.

6. The apparatus of claim 5 wherein said facilities include discrete compartments for containers.

7. The apparatus of claim 1, wherein said magazine comprises a plurality of sections each having facilities for temporary storage of containers.

8. The apparatus of claim 1, wherein said magazine comprises a first section with facilities for temporary storage of containers of at least partially filled trays, and a second section with facilities for temporary storage of containers of empty trays.

9. The apparatus of claim 1, wherein said magazine comprises at least one section with facilities for temporary storage of containers of at least partially filled trays and of containers of empty trays.

10. The apparatus of claim 1, wherein said magazine is flanked by the producing and processing machines.

11. The apparatus of claim 5, wherein said transfer means further comprises means for conveying containers of at least partially filled trays between the producing machines and said facilities of said magazine, and means for conveying containers of empty trays between said facilities of said magazine and the processing machines.

12. The apparatus of claim 1, wherein the producing machines comprise makers of filter rod sections, means for filling empty trays with filter rod sections, and means for delivering filled trays into containers.

13. The apparatus of claim 1, wherein the rod-shaped articles are filter rod sections and the processing machines comprise fluid-operated conveyors, said transfer means further comprising means for evacuating filled trays from said containers of filled trays and means for thereafter delivering filter rod sections from filled trays to said conveyors.

14. The apparatus of claim 1, wherein the producing machines comprise cigarette makers, means for filling empty trays with cigarettes, and means for delivering filed trays into containers.

15. The apparatus of claim 1, wherein the rod-shaped articles are cigarettes and the processing machines comprise cigarette packing machines, said transfer means further comprising means for evacuating filled trays from said containers of filled trays and means for thereafter delivering cigarettes from filled trays to the packing machines.

16. The apparatus of claim 15, wherein the packing machines comprise means for confining arrays of cigarettes in hard packs.

17. The apparatus of claim 16, wherein the packing machines further comprise means for wrapping hard packs into light-transmitting envelopes.

18. The apparatus of claim 1, wherein each producing machine comprises a cigarette maker and a filter tipping machine receiving cigarettes from the maker and filter rod sections from a filter rod making machine.

19. The apparatus of claim 1, wherein each producing machine comprises a filter tow processing machine and a filter rod making machine receiving processed filter tow from the respective filter tow making machine.

20. The apparatus of claim 1, wherein said magazine comprises a plurality of storeys and facilities for temporary storage of containers located at at least one of said storeys.

* * * * *